US010071271B1

(12) United States Patent
Blocker

(10) Patent No.: US 10,071,271 B1
(45) Date of Patent: Sep. 11, 2018

(54) FIRE-HOSE CARRIER

(71) Applicant: William K Blocker, Lexington, SC (US)

(72) Inventor: William K Blocker, Lexington, SC (US)

( * ) Notice: Subject to any disclaimer, the term of this patent is extended or adjusted under 35 U.S.C. 154(b) by 0 days.

(21) Appl. No.: 15/441,488

(22) Filed: Feb. 24, 2017

Related U.S. Application Data

(60) Provisional application No. 62/312,846, filed on Mar. 24, 2016.

(51) Int. Cl.
*A62C 33/04* (2006.01)
*B05B 15/06* (2006.01)
*B05B 15/62* (2018.01)

(52) U.S. Cl.
CPC ..... *A62C 33/04* (2013.01); *B05B 15/061* (2013.01); *B05B 15/62* (2018.02)

(58) Field of Classification Search
CPC ..... B05B 15/62; A62C 33/04
USPC ..... 239/152–154; 169/16, 18, 51, 52
See application file for complete search history.

(56) References Cited

U.S. PATENT DOCUMENTS 612,035 A * 10/1898 Hammerle ..... B05B 7/2408 239/153
2,266,334 A * 12/1941 Rice ..... A62C 33/04 224/236
2,463,736 A * 3/1949 Benson ..... A01M 7/0046 169/30
3,223,172 A * 12/1965 Moss ..... A45F 3/08 169/48
3,275,205 A * 9/1966 Howd ..... A62B 35/00 224/250
4,762,257 A * 8/1988 Spillers ..... A62B 35/0037 224/250
4,858,797 A * 8/1989 Rabska ..... A62C 33/00 224/162
5,195,596 A * 3/1993 Mount, III ..... A62C 33/00 169/52
5,433,288 A * 7/1995 James ..... A62C 33/04 182/3
5,593,092 A * 1/1997 McMillan ..... B05B 15/62 239/285
6,158,670 A * 12/2000 Blocker ..... A62C 33/04 239/153
6,688,538 B2 * 2/2004 Nemoto ..... B05B 9/0403 222/175
2009/0206175 A1 * 8/2009 Salvagno ..... A45F 5/02 239/154
2011/0103778 A1 * 5/2011 Batts ..... F22B 27/16 392/405

* cited by examiner

*Primary Examiner* — Christopher Kim
(74) *Attorney, Agent, or Firm* — Kenneth L Tolar

(57) ABSTRACT

A fire-hose carrier includes a wearable frame formed of a horizontal chest bar with a pair of pivotal shoulder cuffs upwardly extending therefrom. Depending from the chest bar is a vertical spine having an arcuate abdomen plate at a distal end. Removably attached to the abdomen plate is a flow-control module having an inlet connected to a fire hose and an outlet connected to a fire-hose nozzle. The frame is supported on a wearer's shoulders with the abdomen plate encompassing a front portion of the wearer's waist. When high-pressure water is discharged through the nozzle, the resulting force is distributed throughout the wearer's body, allowing the nozzle to be more easily controlled.

11 Claims, 2 Drawing Sheets

FIRE-HOSE CARRIER

CROSS REFERENCE TO RELATED APPLICATIONS

This application is entitled to the benefit of provisional patent application No. 62/312,846 filed on Mar. 24, 2016, the specification of which is incorporated herein by reference.

BACKGROUND OF THE INVENTION

The present invention relates to a wearable frame that allows a firefighter to more comfortably transport, maneuver, position and control a fire-hose nozzle.

DESCRIPTION OF THE PRIOR ART

A firefighter must often hold, transport and operate a fire-hose nozzle for prolonged durations. Because water is discharged at an extremely high pressure, controlling the nozzle with one's hands can be difficult, strenuous and exhausting. Furthermore, when battling a fire, a firefighter must typically carry other tools or ascend a ladder, which requires free hands. Therefore, holding the nozzle while climbing a ladder or using a tool can be impossible. In addition, when moving the hose to another location, the firefighter must often seek assistance from others, who may not be readily available.

Accordingly, there is currently a need for a device that assists a firefighter with holding, transporting and controlling a fire hose. A review of the prior art reveals at least one device that is designed to address the above-described problem. For example, U.S. Pat. No. 6,158,670 to Blocker discloses a fire-hose harness including a chest plate having fixed shoulder cuffs at an upper edge that suspend the plate against a wearer's abdomen. The harness is secured to the wearer with a releasable waistband. Horizontally extending from the chest plate is a conduit having a first end that is coupled with a fire hose and an opposing end that is coupled with a fire-hose nozzle. The conduit is secured to the chest plate with a hinge that allows the entire conduit to be raised to a vertical position when not in use.

Although the device described above frees a firefighter's hands, it has several disadvantages. The shoulder cuffs of the prior-art device are fixedly spaced and therefore cannot be adjusted to accommodate varying size wearers. Likewise, the chest plate has a fixed length and is not adjustable according to the height of the wearer. Furthermore, when the conduit is subjected to high-pressure water, the planar, rectangular chest plate easily shifts and slides on a wearer's abdomen. Therefore, the device requires a cumbersome waistband in order to secure the chest plate to the wearer. The clip on the conduit mates with a ring on the chest plate but only allows the conduit to be secured in a single, upright position. Moreover, the entire conduit, including the inlet and outlet, must pivot in unison so that raising or lowering an attached fire-hose nozzle when a fire hose is attached can be difficult. Finally, because the conduit is permanently attached to the chest plate, the bulky device is difficult to store or maneuver within confined spaces.

The present invention provides an improved fire-hose carrier including a wearable frame having a pair of shoulder cuffs pivotally attached to a horizontal chest bar. Depending from the chest bar is a vertical, length-adjustable spine having an arcuate abdomen plate at a distal end. The shoulder cuffs and spine are adjustable to accommodate varying-size wearers while the arcuate abdomen plate more ergonomically conforms to a wearer's trunk. Therefore, the wearer can more comfortably control the device by engaging the core muscles when an attached fire-hose nozzle is distributing high-pressure water. And the design eliminates the need for releasable straps, waistbands, belts or similar restraints. Furthermore, because the water distribution system is mounted on the arcuate abdomen plate, the wearer can more easily redirect and control the attached nozzle by twisting or turning the trunk as opposed to using the arms or hands. Finally, the water distribution system includes a flow-control module formed of multiple, interconnected, separately rotatable components that allow the nozzle and fire hose inlet to be independently pivoted. Therefore, the nozzle can be adjusted to virtually any desired position while allowing the wearer to more easily transport an attached fire hose. Finally, the flow-control module is completely detachable from the abdomen plate to allow the device to be easily disassembled for storage. Or, if the wearer must suddenly escape a dangerous situation while in a confined or restricted space, the flow-control module can be quickly and easily removed.

SUMMARY OF THE INVENTION

The present invention relates to a fire-hose carrier comprising a wearable frame formed of a horizontal chest bar with a pair of pivotal shoulder cuffs upwardly extending therefrom. Depending from the chest bar is a vertical, length-adjustable spine having an arcuate abdomen plate at a lower distal end. Removably attached to the abdomen plate is a flow-control module having a rotating inlet connected to a fire hose and a locking, rotatable outlet connected to a fire-hose nozzle. The frame is supported on a wearer's shoulders with the abdomen plate encompassing a front portion of the wearer's waist. Therefore, when high-pressure water is discharged through the nozzle, the force emanating from the oscillating fire hose is distributed throughout the wearer's body, allowing the nozzle to be more easily controlled. Furthermore, the secured hose can be easily maneuvered or transported to another location without assistance from another.

It is therefore an object of the present invention to provide a device that stabilizes a fire hose and nozzle during operation.

It is therefore another object of the present invention to provide a wearable frame that allows a firefighter to more comfortably transport, control and maneuver a fire-hose.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
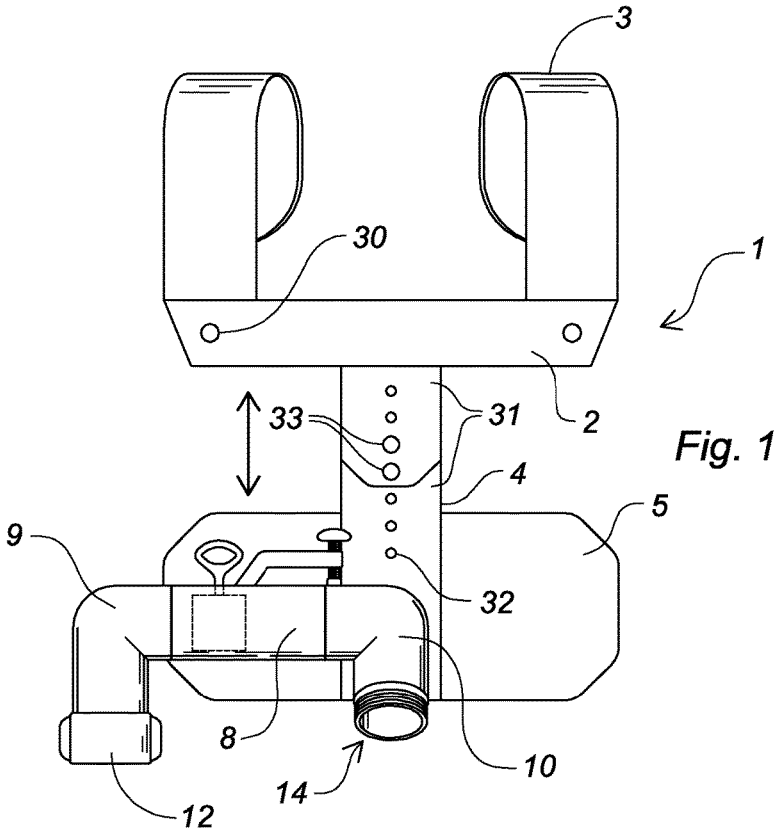
FIG. 1 is a front, plan view of the fire-hose carrier according to the present invention.
Figure 2:
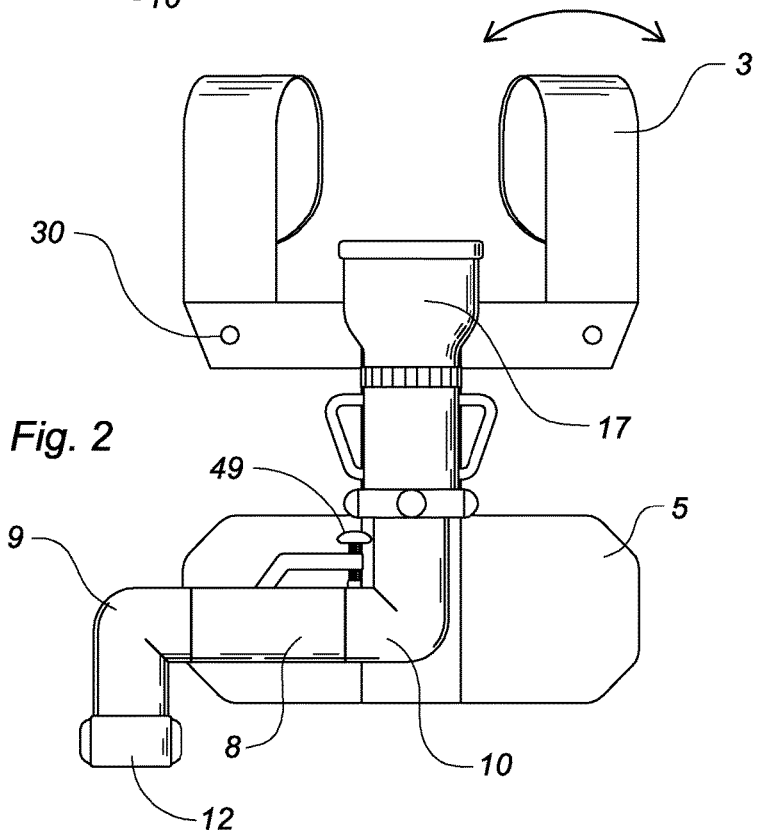
FIG. 2 is a front, plan view of the carrier with the fire-hose nozzle attached.
Figure 3:
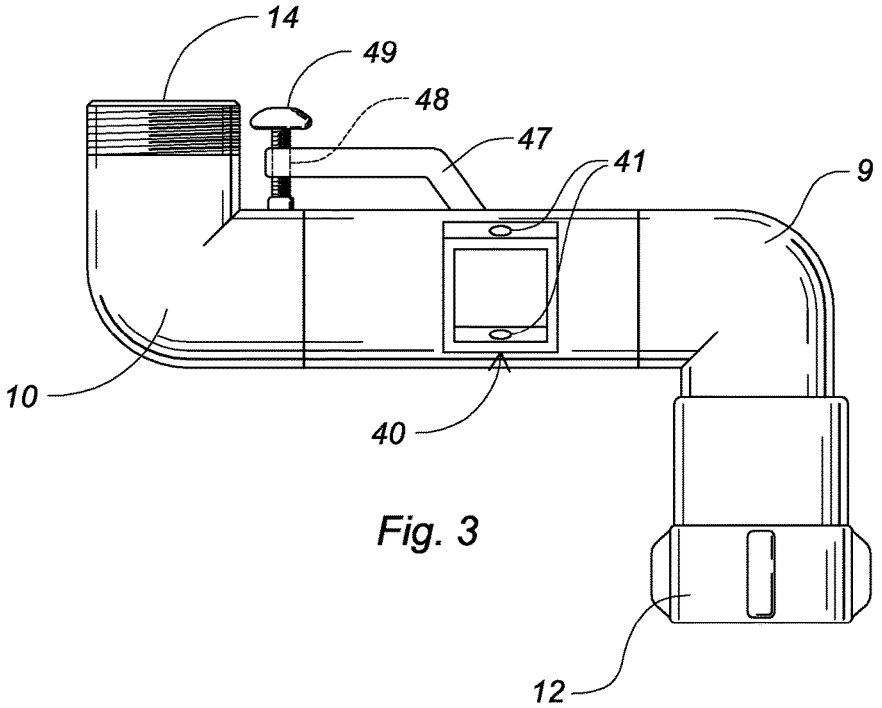
FIG. 3 is an isolated, plan view of the flow-control module.
Figure 4:
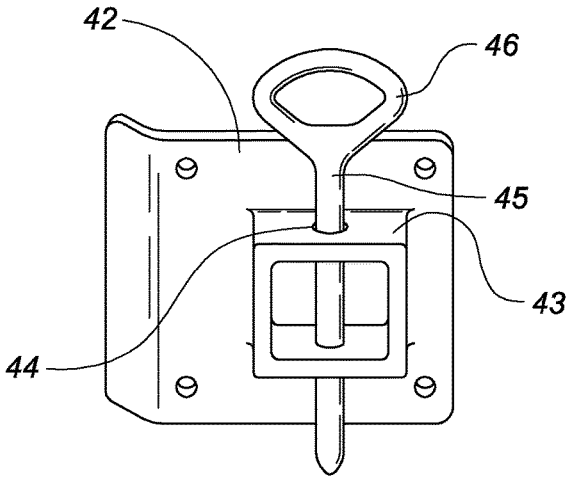
FIG. 4 is an isolated view of the mounting bracket for the flow-control module.
Figure 5:
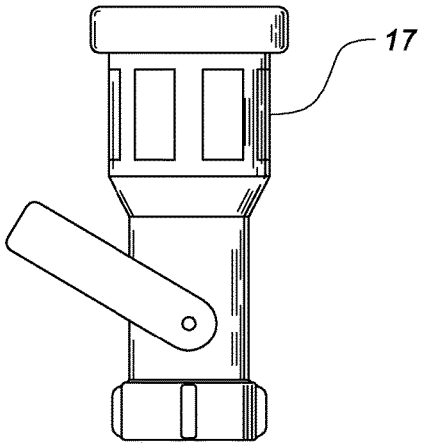
FIG. 5 is an isolated view of an exemplary fire-hose nozzle for use with the carrier according to the present invention.

The present invention relates to a fire-hose carrier comprising a wearable frame 1 formed of a horizontal chest bar 2 with a pair of pivotal shoulder cuffs 3 upwardly extending therefrom. The shoulder cuffs are secured with pins 30, bolts or similar fasteners that are received within holes on the chest bar to allow the cuffs to pivot inwardly and outwardly to accommodate wearers with varying shoulder widths. Depending from the chest bar is a vertical spine 4 having an arcuate abdomen plate 5 at a lower distal end. The spine is length adjustable to accommodate varying size users. For example, the spine may be formed of multiple, overlapping sections 31, each having multiple, vertically oriented apertures 32, any number of which can be aligned to receive fasteners 33 to adjust the overall length.

Removably attachable to the abdomen plate is a flow-control module including a central conduit 8 having an inlet elbow 9 and an outlet elbow 10 attached to one of two opposing ends. Each elbow 9, 10 is completely rotatable within a 360-degree range to facilitate optimum positioning of a connected fire hose or a fire-hose nozzle 17. A free end of the inlet elbow 9 has a coupling 12 that is adapted to connect to the outlet fitting of a designated fire hose. The outlet elbow 10 has a free end 14 that is adapted to couple with a given fire-hose nozzle 17.

Protruding from the exterior surface of the central conduit is a rectangular block 40 having an aperture 41 on each of the upper and lower surfaces. Near an end of the abdomen plate is a mounting bracket 42 having a rectangular plug 43 that firmly fits within or receives the block. The plug 43 includes a pair of aligned apertures 44 for aligning with the block apertures 41 to receive a locking pin 45 to removably secure the flow-control module to the abdomen plate. Therefore, the device can be easily disassembled for storage, or if a firefighter must quickly escape from a dangerous situation within a confined space, the flow-control module can be quickly and easily removed. As such, the pin includes an ovate handle 46 that extends above the central conduit so as to be easily accessible to the wearer in an emergency situation.

Horizontally extending from the upper surface of the central conduit is a substantially L-shaped leg 47 having a threaded bore 48 near a distal end. A threaded locking knob 49 received within the aperture can be tightened against the outlet elbow to fix a connected fire-hose nozzle in a desired orientation. Therefore, a firefighter can lock the fire-hose nozzle at an optimal angle even when pressurized thereby freeing the hands for other tasks.

Accordingly, the frame is supported on a wearer's shoulders with the abdomen plate partially encompassing a front portion of the wearer's waist. The outlet of a fire hose is coupled with the inlet elbow, and the fire-hose nozzle 17 is coupled with the outlet elbow. Therefore, when high-pressure water is discharged through the nozzle, a force emanating from the oscillating fire hose is distributed throughout the wearer's body, allowing the nozzle to be more easily controlled. Furthermore, the secured hose can be easily maneuvered or transported to another location without assistance from another. Additionally, mounting the flow-control module on the abdomen plate transfers the force generated by the fire hose to the wearer's core for enhanced stability.

The pivoting outlet elbow allows the nozzle to be easily moved upwardly or downwardly as desired to project water in a desired direction or to avoid nearby obstructions. The locking knob allows the outlet elbow to be fixed at a desired angle, even while discharging high-pressure water, or to be locked in an upright position when not in use to free the hands for other tasks.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fire-hose carrier comprising:

a wearable frame including a chest bar having a pair of shoulder cuffs upwardly extending therefrom, a spine depending from said chest bar and an arcuate abdomen plate attached to a lower distal end of said spine;

a flow-control module attached to said abdomen plate, said flow-control module including a central conduit with a rotatable inlet and a rotatable outlet, said inlet adapted to connect to a fire hose, said outlet coupled with a fire-hose nozzle.

2. The fire-hose carrier according to claim 1 wherein said flow-control module is removably attached to said abdomen plate.

3. The fire-hose carrier according to claim 1 wherein said spine is length adjustable to accommodate varying-size wearers.

4. The fire-hose carrier according to claim 1 wherein said shoulder cuffs are pivotal outwardly and inwardly to accommodate wearers having varying shoulder widths.

5. The fire-hose carrier according to claim 1 further comprising means for fixing said rotatable outlet at a desired orientation.

6. The fire-hose carrier according to claim 1 further comprising:

a block protruding from an exterior surface of the central conduit, said block having an aperture on an upper surface, and an aperture on a lower surface that is aligned with the aperture on the upper surface;

a mounting bracket on said abdomen plate having a plug extending therefrom that nests with said block, said plug having a pair of aligned apertures that align with the aperture on the upper surface and the aperture on the lower surface of said block when said plug and said block are nested;

a locking pin received within said pair of aligned apertures on said plug and the aperture on the upper surface and the aperture on the lower surface of said block to removably secure the flow-control module to the abdomen plate.

7. The fire-hose carrier according to claim 1 further comprising a leg horizontally extending from said central conduit, said leg having a threaded knob passing therethrough that is tightened against said outlet to fix said outlet at a desired orientation.

8. A fire-hose carrier comprising:

a wearable frame including a chest bar having a pair of pivotal shoulder cuffs upwardly extending therefrom, a length-adjustable spine depending from said chest bar and an arcuate abdomen plate attached to a lower distal end of said spine;

a flow-control module attached to said abdomen plate, said flow-control module including a central conduit with an inlet elbow attached to a first end and an outlet elbow attached to a second end, said inlet elbow adapted to connect to a fire hose, said outlet coupled with a fire-hose nozzle, said outlet elbow and said inlet elbow each independently rotatable within a three-hundred-sixty degree range to allow said fire-hose nozzle and said fire hose to be selectively and independently reoriented relative to said conduit.

9. The fire-hose carrier according to claim 8 further comprising:

a block protruding from an exterior surface of the central conduit, said block having an aperture on an upper surface, and an aperture on a lower surface that is aligned with the aperture on the upper surface;

a mounting bracket on said abdomen plate, said mounting bracket having a plug extending therefrom that mates with said block, said plug having a pair of aligned apertures that align with the aperture on the upper surface and the aperture on the lower surface of said block when said plug and said block are mated;

a locking pin received within said pair of aligned apertures on said plug and the aperture on the upper surface and the aperture on the lower surface of said block to removably secure the flow-control module to the abdomen plate.

10. The fire-hose carrier according to claim 9 further comprising a leg horizontally extending from said central conduit, said leg having a threaded knob passing therethrough that is tightened against said outlet to fix said fire-hose nozzle at a desired orientation.

11. A fire-hose carrier comprising:

a wearable frame including a chest bar having a pair of pivotal shoulder cuffs upwardly extending therefrom, a length-adjustable spine depending from said chest bar and an arcuate abdomen plate attached to a lower distal end of said spine;

a flow-control module removably attached to said abdomen plate, said flow-control module including a central conduit with an inlet elbow attached to a first end and an outlet elbow attached to a second end, said inlet elbow adapted to connect to a fire hose, said outlet coupled with a fire-hose nozzle, said outlet elbow and said inlet elbow rotatable within a three-hundred-sixty degree range to allow said fire-hose nozzle to be selectively reoriented relative to said conduit.

* * * * *